US010647498B1

(12) United States Patent
Brygier, III

(10) Patent No.: US 10,647,498 B1
(45) Date of Patent: May 12, 2020

(54) INSULATED SHIPPING CONTAINER WITH RABBET-JOINT SIDE PANELS

(71) Applicant: Walter Anthony Brygier, III, Hamburg, PA (US)

(72) Inventor: Walter Anthony Brygier, III, Hamburg, PA (US)

( * ) Notice: Subject to any disclaimer, the term of this patent is extended or adjusted under 35 U.S.C. 154(b) by 174 days.

(21) Appl. No.: 15/488,458

(22) Filed: Apr. 15, 2017

Related U.S. Application Data

(60) Provisional application No. 62/324,956, filed on Apr. 20, 2016.

(51) Int. Cl.
*B65D 81/38* (2006.01)
*B65D 81/36* (2006.01)

(52) U.S. Cl.
CPC ..... *B65D 81/3825* (2013.01); *B65D 81/361* (2013.01); *B65D 81/3816* (2013.01); *B65D 81/3823* (2013.01)

(58) Field of Classification Search
CPC ..... B65D 81/3825; B65D 81/361; B65D 81/3816; B65D 81/3823; B65D 81/3813; B65D 81/38; B65B 7/20; B65B 5/04
USPC .... 220/592, 592.01, 592.03, 592.05, 592.09, 220/592.1, 592.2, 592.24, 592.25
See application file for complete search history.

(56) References Cited

U.S. PATENT DOCUMENTS 5,111,957 A 5/1992 Hollander et al.
6,167,624 B1 * 1/2001 Lanahan ..... B26D 1/553 264/142
6,325,281 B1 * 12/2001 Grogan ..... B65D 81/3862 220/592.25
6,868,982 B2 3/2005 Gordon
7,500,593 B2 3/2009 Mayer
8,607,581 B2 12/2013 Williams et al.
8,763,886 B2 7/2014 Hall
8,919,082 B1 * 12/2014 Cataldo ..... B65D 81/3816 220/4.29
2004/0150306 A1 * 8/2004 Steedly ..... A47F 3/14 312/409
2005/0204697 A1 * 9/2005 Rue ..... E04B 1/0023 52/782.1
2011/0114513 A1 * 5/2011 Miller ..... B65D 27/16 206/204

(Continued)

*Primary Examiner* — James N Smalley
*Assistant Examiner* — Madison L Poos
(74) *Attorney, Agent, or Firm* — Hilary J. Sumner

(57) ABSTRACT

Insulated shipping container with rabbet-joint side panels and the procedure for making the same. The insulated shipping container consists of an outer box and six insulated panels. The outer box is made of corrugated fiberboard. The insulated panels are made of expanded polystyrene foam with a thickness of at least 2 inches. The panels are cut with a hotwire machine and the rabbet-joint design locks the side panels in place, which gives the insulated container superb structural and thermal integrity. The box is assembled with a specific H-shape taping and the six panels are inserted to form the insulated container. The invention is the first to meet the packaging requirements of postal carriers and their insurance underwriters. The cost-effective manufacturing process allows for multiple container sizes without additional setup expense, which lowers the cost of shipping affected by dimensional weight versus actual rate shipping rates by the carriers.

6 Claims, 4 Drawing Sheets

(56) References Cited

U.S. PATENT DOCUMENTS

2013/0112695 A1* 5/2013 Hall ..... B65D 5/0227
220/592.25

* cited by examiner

FIG. 2A
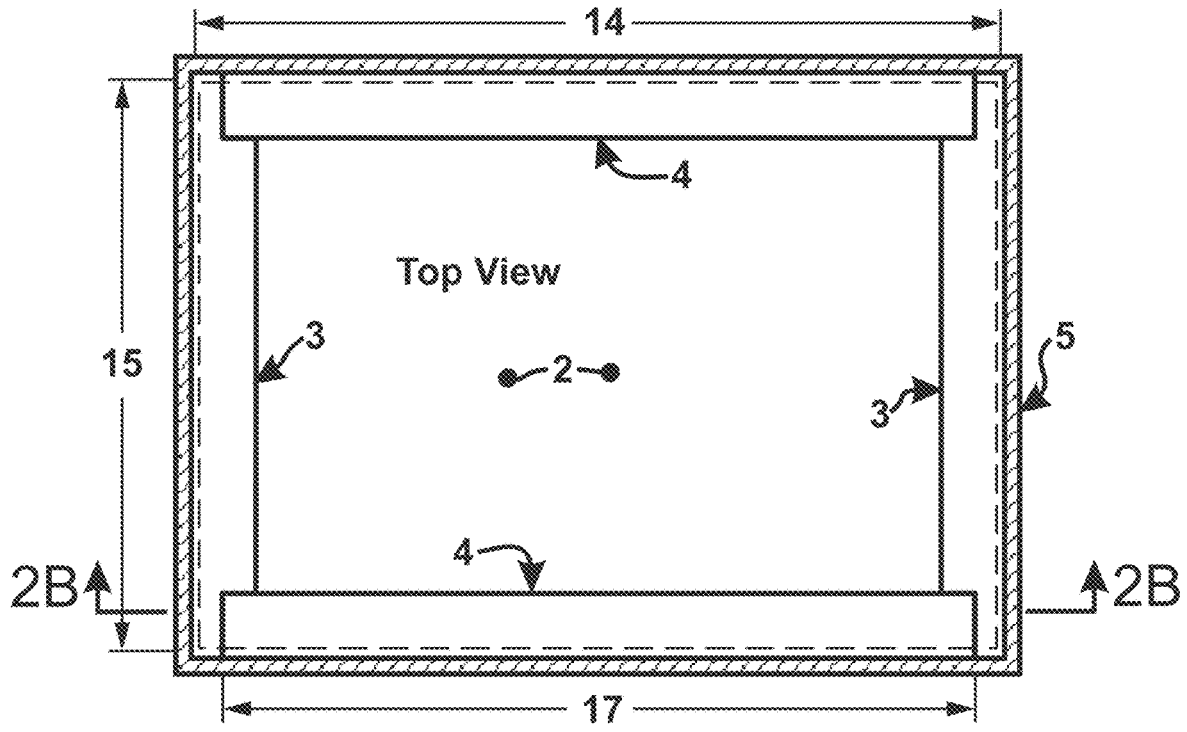
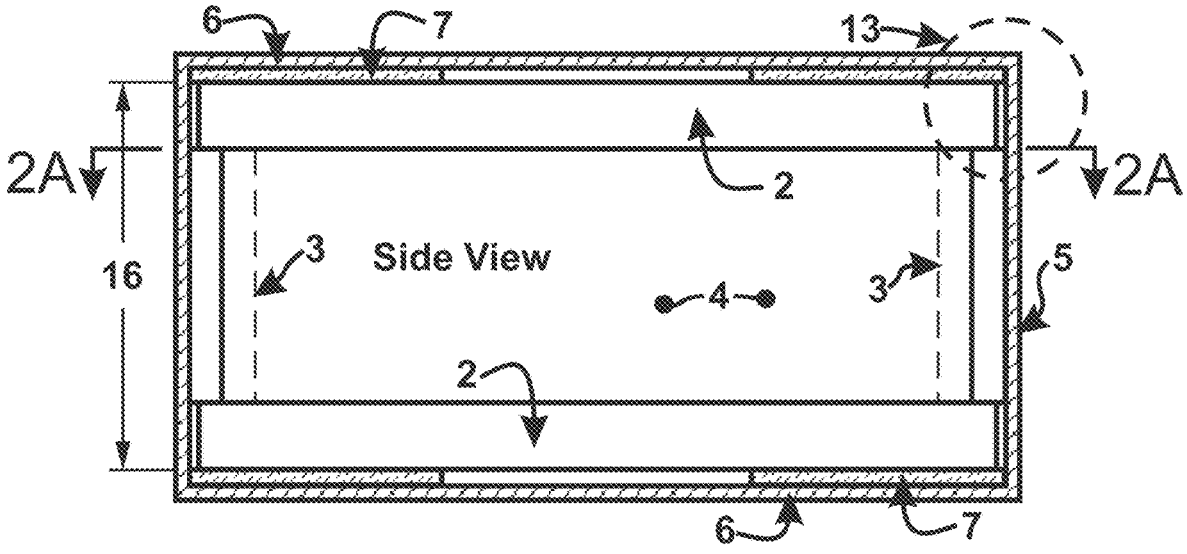
FIG. 2B

FIG. 3A
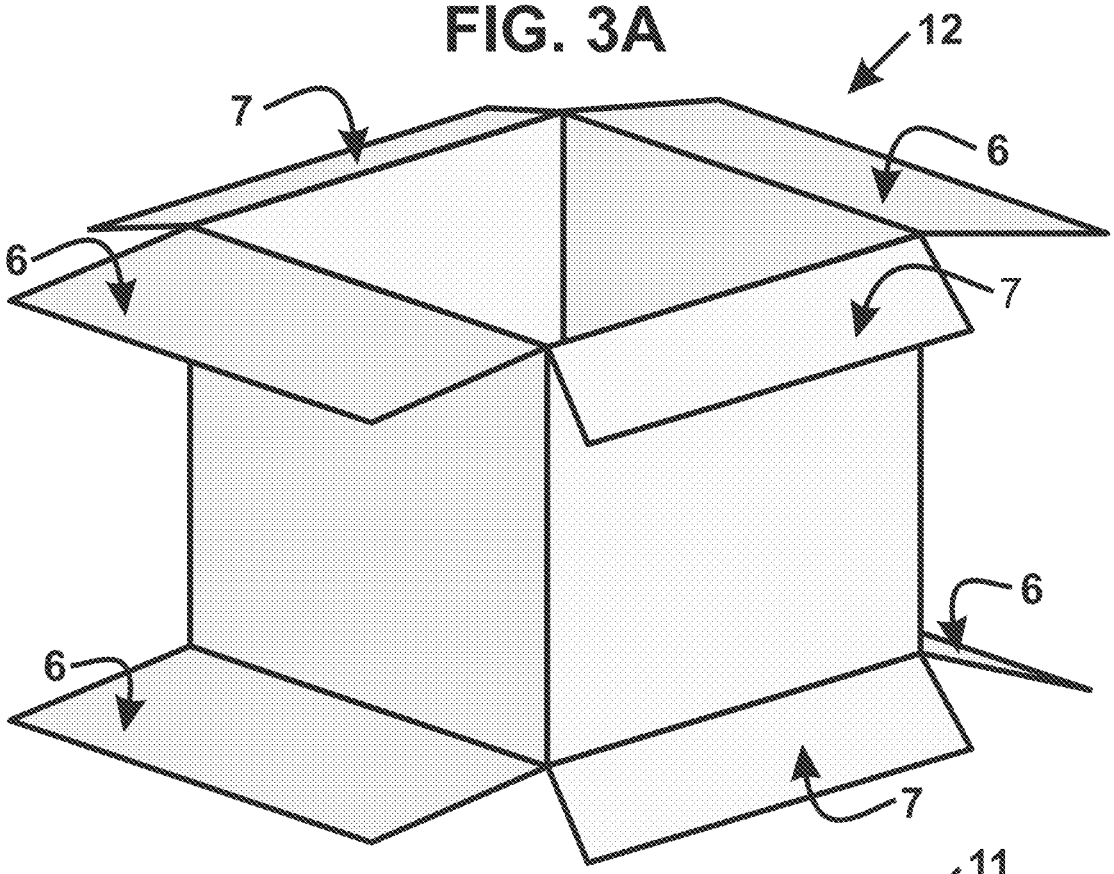
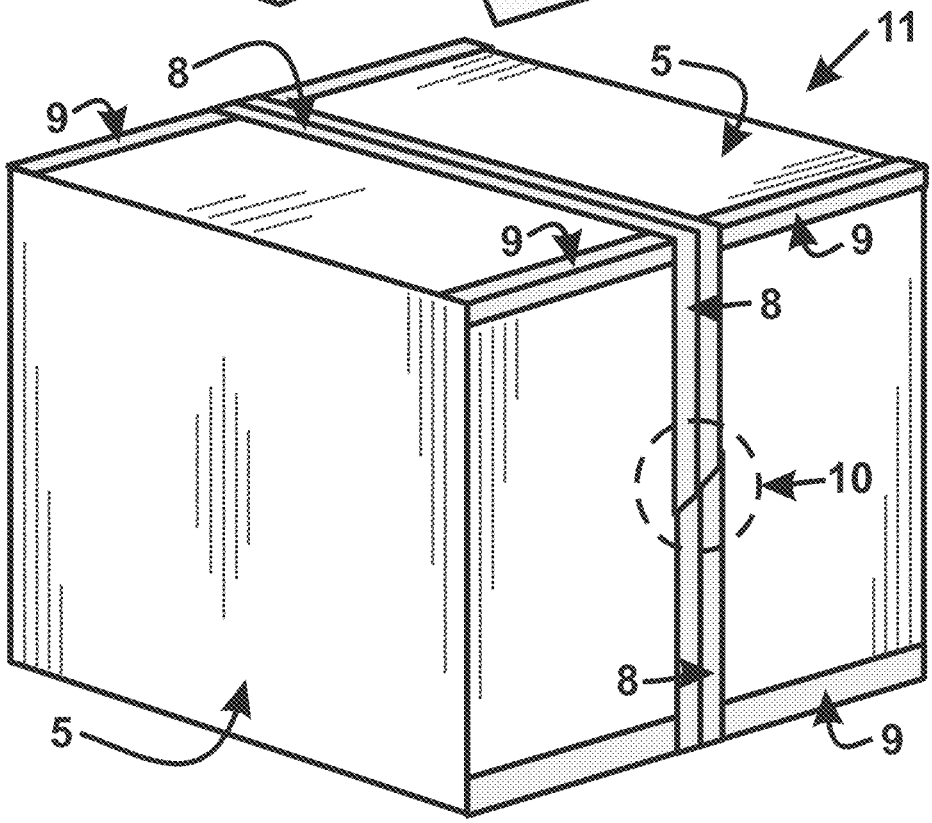
FIG. 3B

FIG. 4A
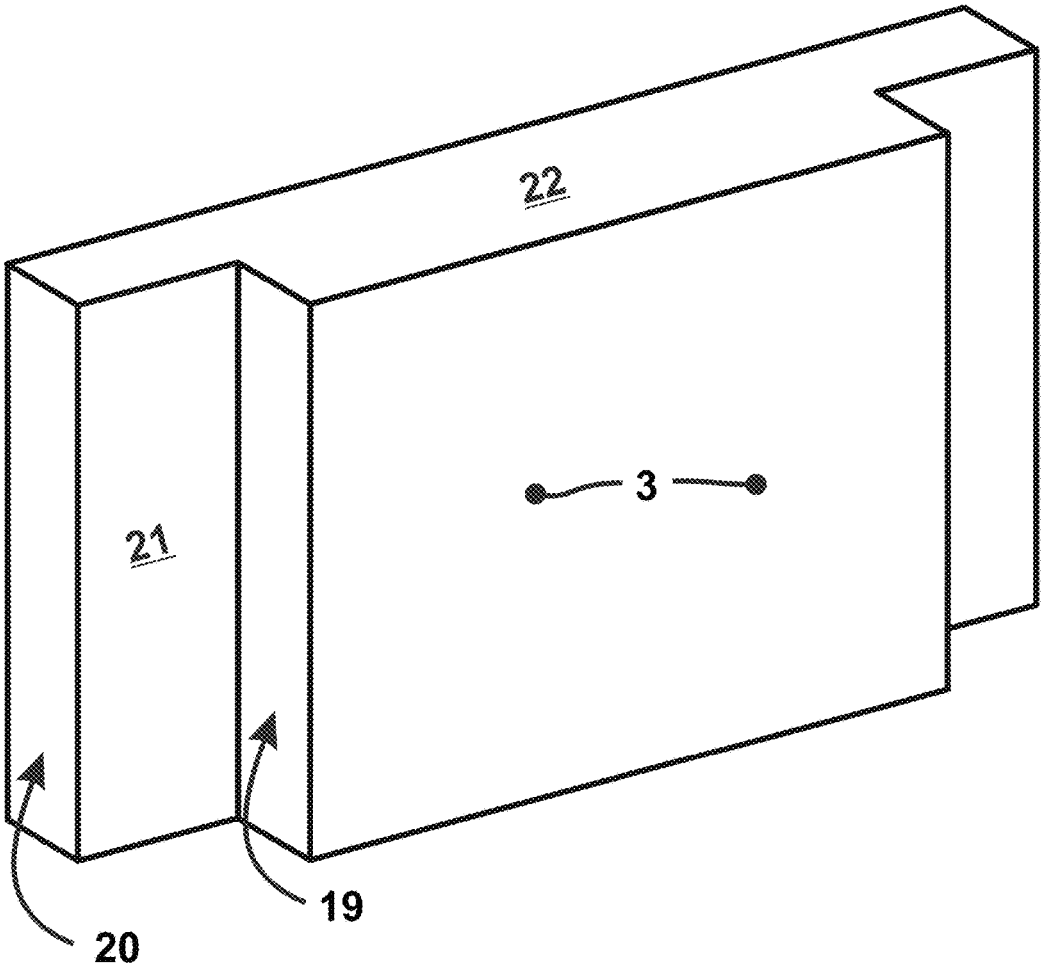
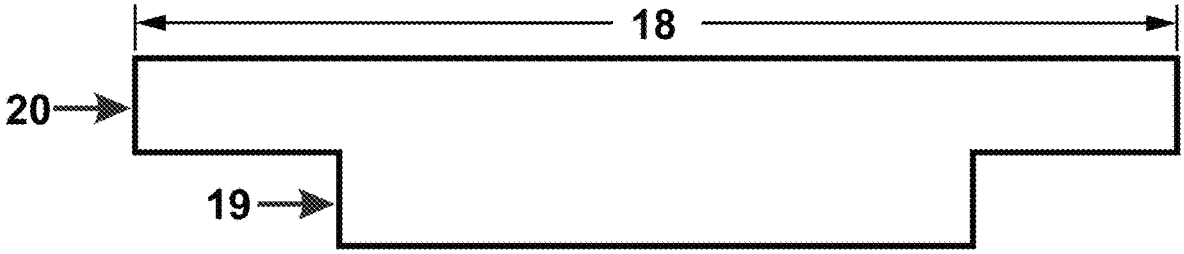
FIG. 4B

INSULATED SHIPPING CONTAINER WITH RABBET-JOINT SIDE PANELS

BACKGROUND OF THE INVENTION

The high cost of shipping perishable foods, especially in warmer ambient temperatures, is a deterrent for private consumers and professional chefs within the HRI industry (Hotels, Restaurants, and Institutions). In warm ambient temperatures, farmers and food suppliers restrict their shipping service to a 1-day transit time, which normally requires expensive overnight air service.

The Prior Art noted displays many designs of insulated shipping containers, but none achieve affordable transport with extended transit times, nor do they address the current packaging guidelines and dimensional weight specifications of common parcel carriers. In order to ship perishable foods cost-effectively, the following conditions must be addressed collectively in a single design:

1. An insulated shipping container must maintain safe food temperatures during transit times of at least 3 days in any ambient temperature up to 95° F. This allows the use of inexpensive Ground service offered by carriers such as United Parcel Service and Federal Express.
2. The design must be structurally sound to the extent that it satisfies the Packaging Guidelines published by United Parcel Service and Federal Express. The aforementioned Packaging Guidelines require each parcel to have a minimum of two inches of padding between the product and outer surface of the packaging container on all sides of the container. Packages that fail to meet this minimum requirement are not considered safe and insurable. Due to the unpredictable positioning of any package on the carriers' truck or railcar, every insulated container must be able to withstand at least 200 pounds of axial load on any side. Adhering to these guidelines assures that insurance claims due to damage by the carrier during transit will be honored.
3. The interior volume of an insulated container must fit the collective volume of the payload to be shipped and the refrigerant required to maintain the desired temperature during the cold chain transit time. There cannot be excess space for two reasons:

a. Excess air inside the insulated container will accelerate the endothermic process inside an insulated container.
b. Shipping rates are calculated by the larger of either the actual weight as measured on a scale, or by Dimensional Weight as calculated by multiplying the length, width, and height of a package and then dividing that product by a set divisor established by the shipping carrier. For instance, a 20×16×14 inch empty box will be billed as if the box weighed 33 pounds even though the actual scaled weight of the box is only 2 pounds. Therefore, a container that is unnecessarily larger than what is required will cost more to ship.

In order to avoid the excess shipping of Dimensional Weight as enforced by the shipping carriers, the design of an insulated container must be flexible to accommodate any interior volume and rectangular dimension to the extent that there is no additional expense during the manufacturing process attributed to re-tooling or setup of the manufacturing equipment.

4. Regardless of size, insulated shipping containers should collapse or breakdown to affect minimal storage and maximum quantity on a shipping pallet. This lowers the cost of shipping bulk amounts to shippers and reduces the storage space required at the shipping facility.

The present industry standard for shipping perishable foods consists of a 2-piece insulated container molded of Expanded Polystyrene (EPS) that is usually placed inside a corrugated box. The section that holds the product and refrigerant is unitary with a bottom and four sides molded in a single section. The top usually has a groove around the perimeter that fits into compatible grooves on the top edge of the lower section. This system has shortcomings inherent to the design that limits transit times and causes structural failure:

1. The wall thickness of molded coolers is normally less than 2" thick. This specification does not adhere to the Packaging Guidelines published by United Parcel Service and Federal Express, which voids any insurance claim when there is damage during transit.
2. The thickness of any insulating material is a factor that dictates the R-value or measure of thermal resistance of that material. The R-value of Expanded Polystyrene with a 1-pound density is 4.17 per inch of material at a mean temperature of 40° F. and 3.85 per inch of material at a mean temperature of 75° F. Consequently, the 2-inch thickness of insulation used in the present invention provides a total R-value is 8.34 at a mean temperature of 40° F. In contrast, molded coolers have R-values between 3.85 and 5.78. We tested a variety of molded EPS coolers using temperature data loggers and actual transit conditions. Our tests show that when the R-value of an insulated molded cooler is less than 6.0, the resistance to heat flow is insufficient to keep perishable food safe during transit times of more than 30 hours in ambient temperatures above 70° F.
3. Molded coolers require more storage space. Examples:

a) A 12"×10"×10" molded cooler requires 1200 cubic inches of storage, which is 25% more than our system.
b) A 20"×14"×12" molded cooler requires 3360 cubic inches of storage, which is 57% more than our system.
c) A 30"×20"×14" molded cooler requires 8400 cubic inches of storage, which is 94% more than our system.

4. Because molded coolers require more storage space, shipping bulk quantities requires more pallets. This extra shipping cost raises the bottom-line purchase price of molded coolers.
5. Molded 2-piece coolers have a high rate of structural failure during transit. Their unitary design will not withstand axial or lateral impact from normal carrier handling during transit. The fractures normally start at the vertical and bottom corners and then migrate across the bottom of the cooler. This causes thermal failure and eventually spoiled food.
6. The corrugated boxes supplied with molded coolers are pre-assembled using a single layer of tape. This does not adhere to the Packaging Guidelines published by United Parcel Service and Federal Express and may void any insurance claim when there is damage during transit.
7. In order to manufacture a molded 2-piece cooler, very expensive tooling is required for each individual size.

This invention solves all of the shortcomings of previous and existing insulated cooler designs. Furthermore, this invention has been extensively tested in all ambient temperatures under rigorous handling conditions in transit by United Parcel Service.

BRIEF SUMMARY OF THE INVENTION

The objective of this invention is to provide an insulated shipping container that resolves the shortcomings of existing industry designs. The invention meets the packaging guidelines of United Parcel Service and Federal Express. The amount of insulating foam material provides the thermal quality to withstand at least three days of transit time in any ambient temperature. The insulated shipping containers are available in at least 200 sizes without any additional setup costs during manufacture, thus resolving the high shipping rates associated with the new dimensional weight policies of shipping carriers. This invention is cost-effective in terms of raw material and manufacture.

BRIEF DESCRIPTION OF THE DRAWINGS

FIG. 2A is a top sectional view of an assembled insulated shipping container according to the invention.

FIG. 2B is a side sectional view of the insulated shipping container shown in FIG. 2A.

FIG. 3A is a perspective view of a corrugated container used in the shipping container of the invention in an unfolded condition.

FIG. 3B is a perspective of the corrugated container of FIG. 3A in a folded and sealed condition.

FIG. 4A. is a perspective view of a rabbet-joint end panel of thermal insulation used in the shipping container according to the invention.

FIG. 4B is a top end view of the rabbet-joint end panel of FIG. 4A.

DETAILED DESCRIPTION OF THE INVENTION

Figure 1:
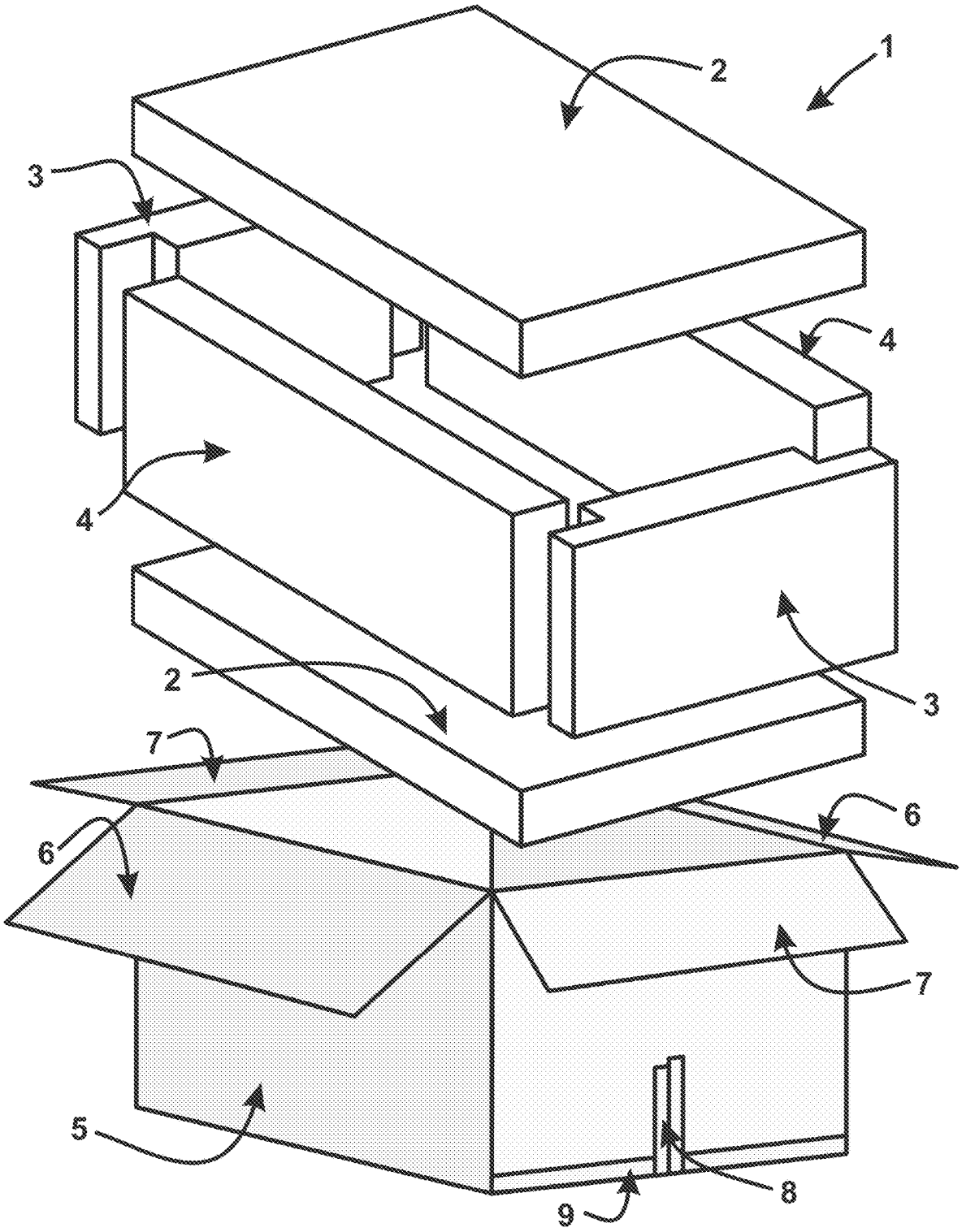
FIG. 1 is an exploded view that shows an embodiment of the insulated shipping container according to this invention.

An embodiment of a rabbet-joint collapsible insulated shipping container according to the invention is referenced by numeral 1 in FIG. 1. Insulated shipping container 1 is comprised of an outer box 5 constructed of corrugated fiberboard manufactured in the Regular Slotted Container (RSC) style, an unfolded embodiment of which is shown in FIG. 3A and referenced in numeral 12. Continuing in FIG. 3A, there are two major flaps 6 and two minor flaps 7 that form the top and bottom of the box 5 and all of the flaps are preferably the same length. The major or outer flaps 6 meet in the center when folded; forming the closure of the box on the top and bottom; and, are joined and sealed with tape as shown in FIG. 3B to form a closed and taped box embodiment 11. The minor or inner flaps will not meet in the center if the dimensions of the length and width of the box form a rectangle. The minor flaps will meet in the center if the length and width dimensions are equal. The box 5 can be any dimensional size with a minimum burst test specification of at least 200 pounds per square inch and a minimum edge crush test specification of at least 40 pounds per inch width.

The box 5 is preferably taped in the manner depicted in FIG. 3B. The major flaps 6 on the top and the bottom of the box are preferably sealed with two separate and continuous pieces of packing tape 8 that is preferably at least two inches wide and made preferably with a rubber-base adhesive. The two continuous pieces of tape 8 start midway down the side of the box 5; continue across the bottom seam of the major flaps 6; and, end midway down the opposite side of box 5. The edges perpendicular to the center seam are preferably sealed with a singular piece of tape 9, such that the tape is applied to adhere tightly to both the bottom and opposing sides of box 5. The top is sealed in the same manner taking care to overlap the side pieces of tape onto the previously applied tape used to seal the bottom as at location 10. This entire taping process is known as an H-tape configuration and is important for towards maintaining both the structural and thermal integrity of the insulated shipping container.

The plurality of the six insulated panels that form the interior compartment are shown in FIG. 1. The panels are cut from large blocks of expanded polystyrene (EPS) with a nominal density of 1.0 pounds per cubic foot, commonly known as Type 1 EPS. The EPS blocks are cut with an automated multi-wire hotwire machine into slabs that have a nominal thickness of at least 2.00 inches. These slabs, normally measuring 96 inches by 48 inches by 2 inches thick, are the base material from which the panels 2, 3, and 4 that form the insulated portion of the container are cut.

Referring now to FIGS. 2A and 2B, the bottom of box 5 is folded and taped for the purpose of taking measurements. Two measurements are taken from the interior of the box 5 at the lowest point. The first measurement 14 is taken across the length of the interior bottom between the creases of the minor flaps 7. That measurement minus 0.125 inches defines the nominal length of the top 2 and bottom 2 EPS panels. The second measurement 15 is taken across the width of the interior bottom between the creases of the major flaps 6. That measurement minus 0.25 inch defines the nominal width of the top 2 and bottom 2 EPS panels. As shown in numeral 13, both of these measurements are shorter than the actual interior of the box for the purpose of allowing lateral compression of the side panel joinery when the box 5 is packed and closed for shipment.

Referring now to FIGS. 4A and 4B, the length 18 of the rabbet-joint side panel 3 is measured and cut to fit snug between the walls of the box. The rabbets are preferably cut on an automated hotwire machine in such a manner that the shoulder 19 and end 20 have the same measurements. This is achieved by programming the hotwire to cut perfectly into the center of the thickness 22 of the sheet on opposite sides of the panel 3. The length of the cheek 21 is the same as the thickness of the panel 22. This operation leaves a rabbet-cut on the residual material that matches those on the cut panel 3. The cut on the residual material can be used for future rabbet panels, thus reducing labor and eliminating waste of the EPS slabs.

Referring back to FIGS. 1, 2A, and 2B, the lengths of the straight side panels 4 are determined by inserting a rabbeted panel 3 into opposite sides of the partially assembled box 5. A measurement is then taken between the cheeks 21 of the opposing rabbeted panels. The straight panels 4 are cut to length on a hotwire machine from raw sheets of EPS.

As shown in FIG. 2B, the heights of the side panels 3 and 4 are measured vertically from the top of the lower minor flap 7 on the inside of a partially assembled box 5, to the bottom of the upper minor flap 7. That measurement is the height of the side panels 3 and 4. The side panels 3 and 4 are cut on a hotwire machine.

Once all six panels are cut to the desired dimensions, they are inserted into the box 5 as shown in FIG. 1, starting with a bottom panel 2; followed by rabbeted panels 3 on opposite sides of box 5; followed by straight panels 4 between the rabbeted panels; and the followed by a top panel 2. The assembly of the insulation panels provides an insulated chamber within the box 5 wherein perishable food products and refrigerant can be inserted for shipping.

The insulated shipping container according to my invention satisfies the packaging guidelines of common postal carriers and their insurance underwriters such that damage caused by said carriers during transit is warranted to be covered by said insurance underwriters.

I claim:

1. A process for making an insulated shipping container comprising the steps of:

providing an outer container having an interior and six sides, each of said six sides having an interior surface, said six sides including a front, a back, a right, a left, a top, and a bottom, the top and bottom sides having open portions and two sets of foldable flaps for closing off said open portions of the outer container;

cutting a top panel to substantially cover the interior surface of the top side of the outer container wherein said insulated top panel is expanded polystyrene having a nominal density of 1.0 pounds per cubic foot and a thickness of at least two inches;

cutting a bottom panel to substantially cover the interior surface of the bottom side of the outer container wherein said insulated bottom panel is expanded polystyrene having a nominal density of 1.0 pounds per cubic foot and a thickness of at least two inches;

cutting a first side panel to substantially cover the interior surface of the front side of the outer container wherein said first side panel is expanded polystyrene having a nominal density of 1.0 pounds per cubic foot and a thickness of at least two inches;

cutting a second side panel to substantially cover the interior surface of the back side of the outer container wherein said second side panel is expanded polystyrene having a nominal density of 1.0 pounds per cubic foot and a thickness of at least two inches;

cutting a first end panel to fit snugly within and substantially cover the interior surface of the right side of the outer container, wherein said end panel has a left side and a right side and wherein said first end panel is expanded polystyrene having a nominal density of 1.0 pounds per cubic foot and a thickness of at least two inches;

cutting a rabbet joint in the left and right sides of the first end panel;

cutting a second end panel to fit snugly within and substantially cover the interior surface of the left side of the outer container, wherein said end panel has a left side and a right side and wherein said second end panel is expanded polystyrene having a nominal density of 1.0 pounds per cubic foot and a thickness of at least two inches;

cutting a rabbet joint in the left and right sides of the second end panel;

folding one set of foldable flaps on the outer container to provide a closed bottom side;

sealing the closed bottom side;

placing the bottom panel into the outer container so that it substantially covers the interior surface of the closed bottom side;

placing the first end panel into the outer container so that it substantially covers the interior surface of the right side of the outer container and so that the rabbet joints of said first end panel are oriented toward the interior of the outer box;

placing the second end panel into the outer container so that it substantially covers the interior surface of the left side of the outer container and so that the rabbet joints of said second end panel are oriented toward the interior of the outer box;

placing the first side panel into the outer container so that it substantially covers the interior surface of the front side of the outer container and engages with the rabbet joints of the first and second end panels;

placing the second side panel into the outer container so that it substantially covers the interior surface of the back side of the outer container and engages with the rabbet joints of the first and second end panels, forming an insulated chamber having an open face;

placing the top panel to substantially cover the open face of the insulated chamber;

folding the second set of foldable flaps to provide a closed top wall of the outer container;

compressing the outer container such that the rabbet joints of the first and second end panels come in full and direct contact with the adjacent side panels creating tightly fitting, impact-resistant joints; and sealing the closed top wall in a manner that maintains this compression.

2. The process of claim 1, wherein said outer container is formed of a corrugated material.

3. The process of claim 2 wherein the corrugated material is fiberboard or cardboard.

4. The process of claim 1 wherein the step of sealing the closed bottom wall comprises the steps of:

applying a first strip of adhesive tape from a point that is midway along an end wall of the outer container, along a bottom seam between the bottom flaps, and then midway along the opposing end wall of the outer container; and then applying a second strip of the adhesive tape from the point that is midway along the end wall of the outer container, along the bottom seam between the bottom flaps, and then midway along the opposing end wall of the outer container.

5. The process of claim 4 comprising the steps of:

applying a third strip of adhesive tape along the full length of an edge of the bottom wall that is perpendicular to the seam between the bottom flaps, and applying a fourth strip of adhesive tape along the full length of an opposite parallel edge of the bottom wall that is perpendicular to the seam between the bottom flaps, wherein the third and fourth strips of adhesive tape are applied such that they contact the bottom wall and respective sides wall of the outer container.

6. An insulated shipping container for perishable foods comprising:

an outer collapsible container, the container being folded into a box having an exterior, an interior base, four interior side walls and an interior top;

an inner insulating chamber comprising:

i) a bottom insulating panel disposed in and substantially covering the interior base of said foldable box wherein said bottom insulating panel is expanded polystyrene having a nominal density of 1.0 pounds per cubic foot and a thickness of at least two inches;

ii) a pair of side insulating panels disposed in and substantially covering two opposing interior side walls wherein said side insulating panels are expanded polystyrene having a nominal density of 1.0 pounds per cubic foot and a thickness of at least two inches;

iii) a pair of end insulating panels, each end insulating panel having a left and right side and the pair of end insulating panels snugly fitting within and substantially covering the remaining two opposing interior side walls and abutting the side insulation panels, wherein each of said end insulating panels is expanded polystyrene having a nominal density of 1.0 pounds per cubic foot and a thickness of at least two inches and wherein each left and right side comprises a rabbet to accommodate and engage with the thickness of the abutting side insulating panels; and iv) a top insulating panel disposed in and substantially covering the interior top of said foldable box wherein said top insulating panel is expanded polystyrene having a nominal density of 1.0 pounds per cubic foot and a thickness of at least two inches;

wherein said exterior of said outer box is compressed, closed and sealed such that the rabbet joints of the first and second end panels come in full and direct contact with the adjacent side panels creating tightly fitting, impact-resistant joints.

* * * * *